US005134936A

United States Patent [19]

John

[11] Patent Number: 5,134,936

[45] Date of Patent: Aug. 4, 1992

[54] SET-UP METHOD FOR A PRINTING SYSTEM, AND RESULTING PRINTING SYSTEM

[75] Inventor: Thomas John, Augsburg, Fed. Rep. of Germany

[73] Assignee: MAN Roland Druckmaschinen AG, Offenbach am Main, Fed. Rep. of Germany

[21] Appl. No.: 604,772

[22] Filed: Oct. 26, 1990

[30] Foreign Application Priority Data

Nov. 18, 1989 [DE] Fed. Rep. of Germany ..... 3938448

[51] Int. Cl.[5] ..... B41F 9/10; B41F 3/81

[52] U.S. Cl. ..... 101/157; 101/170; 101/348

[58] Field of Search ..... 101/142, 155, 156, 157, 101/170, 348, 350, 363

[56] References Cited

U.S. PATENT DOCUMENTS

| | | | |
|---|---|---|---|
| 2,605,684 | 8/1952 | Nagels et al. | 101/170 |
| 3,044,396 | 7/1962 | Aller | 101/157 |
| 3,392,667 | 7/1968 | Cassel et al. | 101/170 |
| 3,738,266 | 6/1973 | Maeda et al. | 101/153 |
| 3,814,014 | 6/1974 | Dahlgren | 101/157 |
| 3,910,186 | 10/1975 | D'Amato et al. | 101/156 |
| 4,130,056 | 12/1978 | Mabrouk et al. | 101/147 |
| 4,621,575 | 11/1986 | Jeschke | 101/142 |
| 4,672,893 | 6/1987 | Mammarella, Sr. | 101/170 |
| 4,676,157 | 6/1987 | Ichikawa et al. | 101/155 |
| 4,805,530 | 2/1989 | Kobler et al. | 101/350 |
| 4,901,641 | 2/1990 | Steiner et al. | 101/157 |

FOREIGN PATENT DOCUMENTS

| | | |
|---|---|---|
| 0101266 | 2/1984 | European Pat. Off. . |
| 0279295 | 8/1988 | European Pat. Off. . |

OTHER PUBLICATIONS

Polygraph, Bd. 26, Nr. 9, May 5, 1973, pp. 632–636.

*Primary Examiner*—Edgar S. Burr
*Assistant Examiner*—Lynn D. Hendrickson
*Attorney, Agent, or Firm*—Frishauf, Holtz, Goodman & Woodward

[57] ABSTRACT

To associate the ink requirement of subject matter to be printed from a printing forme (6, 27) to the ink being supplied thereto by an ink application cylinder (5, 26), the ink application cylinder is provided with a jacket, sleeve or cover having a cellular surface, and in which the cell distribution or cell configuration of the surface is matched, at least approximately, and, for example, in zones or regions, to the subject matter to be printed from the forme. The ink can be transferred by an ink application roller, in which a plate cylinder carries the forme, and the ink application roller, the plate cylinder and the cylinder with the cellular surface cover all have essentially the same diameter and are all driven at the same speed. Pre-forming the cell distribution or cell configuration on a jacket or cover, which may be in form of a plate applied to the ink supplying cylinder, or a sleeve, can accurately meter ink for the forme cylinder, without requiring wear-causing engagement pressures of a doctor blade against the cellular surface.

13 Claims, 2 Drawing Sheets

SET-UP METHOD FOR A PRINTING SYSTEM, AND RESULTING PRINTING SYSTEM

Reference to related patents and applications, the disclosures of which are hereby incorporated by reference, assigned to the assignee of the present application:

U.S. Ser. No. 07/607,533, filed Nov. 1, 1990, JOHN

U.S. Ser. No. 07/593,039, filed Oct. 5, 1990, JOHN

U.S. Pat. No. 4,805,530, KOBLER et al (to which German 37 06 011 corresponds);

U.S. Pat. No. 4,938,133, Bock et al,

Reference to Related Literature

GlüCK: "Untersuchung des Rollverhaltens von Mehrwalzen-Systemen unter Einbeziehung einer visko-elastischen Walze" ("Investigation of Behavior of Rollers including a Viscous Elastic Roller in Multi-Roller Systems"), TH Darmstadt (Technical University Darmstadt), 1976; page 166 et seq.

FIELD OF THE INVENTION

The present invention relates to a method to set up a printing system preparatory to printing on a printing carrier or substrate, and to a printing apparatus and system in which the method is used.

DEFINITION

The term "cellular surface" will be used hereinafter to describe an ink transfer surface having small ink receptor depressions or cells, which are used, for example, in anilox rollers or cylinders, gravure cylinders or the like.

BACKGROUND

Many printing systems utilize inkers having a cylinder or roller with a cellular surface. The cellular surface may be formed by a cellular surface layer, or the roller may, itself, have cells or depressions or ink receptors formed therein. Such cellular surface rollers are customarily in operative engagement with a doctor blade. The cellular surface roller may be driven, for example with the same speed as a forme cylinder, particularly if the diameter of the forme cylinder and that of the cellular cylinder are the same, when in operative state, that is, when the forme cylinder has a printing forme, such as a printing plate, applied thereto.

U.S. Pat. No. 4,805,530, Kobler et al, assigned to the assignee of the present application, and the disclosure of which is hereby incorporated by reference, describes an inker with a cellular cylinder, in which the cells or receptors of the cylinder are formed in a compressible layer. This compressible layer may be constructed, for example, as a replaceable element. By changing the engagement pressure of the doctor blade, the volume of the cells or ink receptor depressions in the cellular surface can be changed and, consequently, the quantity of ink supplied to the forme cylinder can be changed. Changing the quantity of ink being transferred within specific regions of the forme cylinder, which means changing the quantity of ink in regions of the cellular surface plate, or cylinder, is desirable, but was not contemplated when the development of the Kobler patent was made. In the meanwhile, also, it has been found that the compressible layer on the cellular surface cylinder is subject to substantial wear due to the engagement of the doctor blade against the compressible layer.

THE INVENTION

It is an object to provide a method, and an apparatus suitable to carry out the method, and a printing system resulting from the method, in which the quantity of ink being supplied to the forme cylinder can be accurately controlled in circumferential zones and/or in axial zones of a cellular surface, e.g. on a roller, and in which the cellular surface roller is subjected only to minor wear, substantially less than heretofore.

Briefly, based on subject matter to be printed, the ink requirements of the printing forme in respective zones are determined. These zones may include regions of printing subject matter and non-printing regions. A cellular surface is so prepared that the ink collecting in the cells will at least approximately match the ink requirement of the respective zones of the printing forme. This matching of ink requirements is carried out by arranging the cellular surface such that the cell distribution and/or the cell configuration of the cellular surface is matched to deliver ink such that the ink collected in the cells will at least approximately conform to or match the ink requirement of the respective zones of the forme. The so-prepared cellular surface is then applied to an ink supplying cylinder element to form a cellular ink transferring cylinder.

The arrangement has the advantage that the cells on the roller or cylinder are pre-shaped or pre-distributed to provide the requisite ink, no more and not less than that demanded by the subject matter, and that deformation of the cellular surface by the doctor blade, which caused the wear, is no longer required.

DRAWINGS

DETAILED DESCRIPTION

Figure 1:
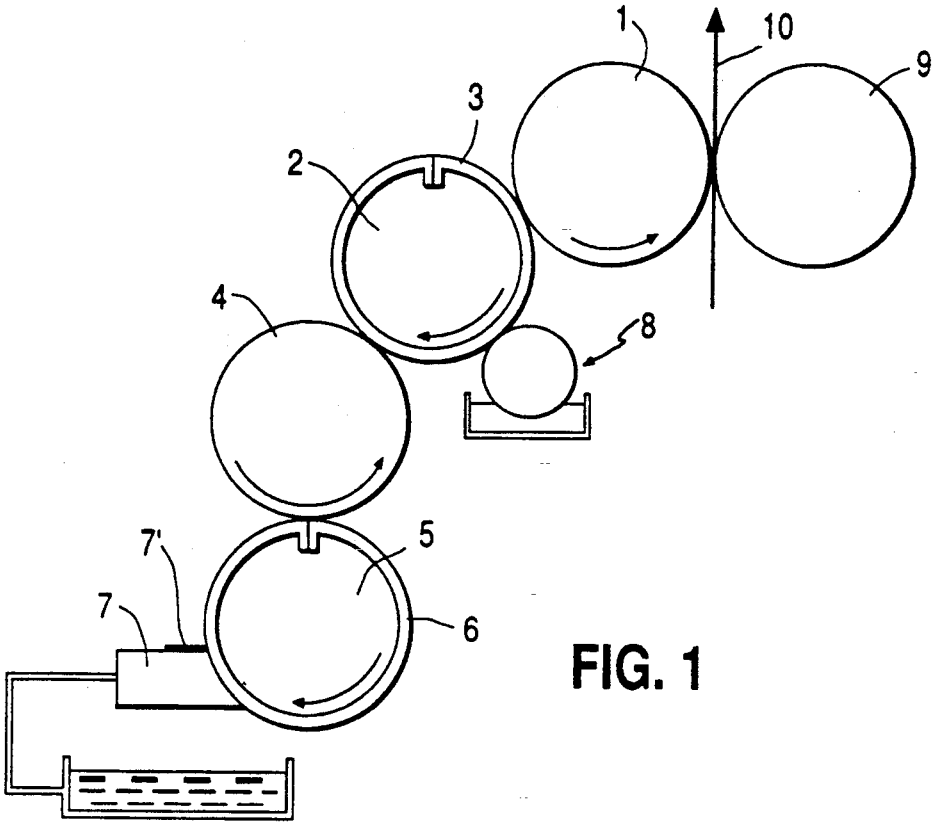
FIG. 1 is a highly schematic side view of an offset printing machine in which the present invention can be used.

The invention will first be explained with reference to an offset printing system. FIG. 1 illustrates such a system which includes a rubber blanket cylinder 1, a plate or forme cylinder 2 on which a printing plate 3 is clamped, suitable to be offset on blanket cylinder 1. A printing substrate 10 is passed between the blanket cylinder 1 and a counter or impression cylinder 9. The impression cylinder 9 may, itself, be a blanket cylinder.

The forme cylinder 2 receives ink from an ink application roller or cylinder 4. The ink application cylinder 4 has a yielding, ink-accepting surface. Ink is applied to the ink application cylinder 4 from a cellular surface cylinder 5. The cellular surface cylinder 5 has a cover, in form of a jacket or a sleeve 6 applied thereto, in which the jacket or sleeve 6 has the cellular surface. The diameter of the cylinder 5, when covered by the jacket or, if continuous, by the sleeve 6, has the same diameter as the forme cylinder 2, with the printing forme thereon. The forme cylinder 2, as well as the cylinders or rollers 4, 5, are driven with the same circumferential speed.

The cover 6, in which cells or ink receptor depressions are formed, is made of a hard material with a smooth surface, which smooth surface then has the receptor depressions or cells applied therein. In the selected example, the cover 6 is formed as a gravure wrap-around plate element. A chambered doctor blade unit 7 having a doctor blade 7', is applied against the surface of the cellular surface roller 5. The chambered doctor blade unit 7 applies ink to the surface of the cellular surface layer or cover 6 which is stripped off the surface of the cellular layer by the doctor blade 7', leaving ink within the receptor cells of the cellular surface.

FIG. 1 further illustrates a damper 8, only shown schematically, to apply damping liquid, typically water, to the forme cylinder 2.

Figure 2:
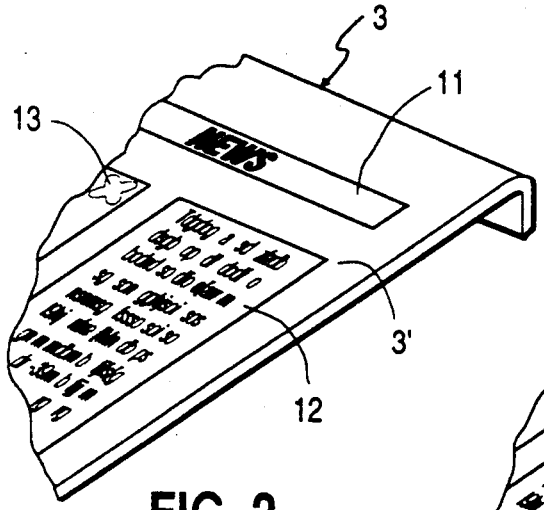
FIG. 2 is a fragmentary perspective view of a printing forme ready to be printed in an offset printing machine.

Let it be assumed that the subject matter to be printed has the configuration shown in FIG. 2, which, schematically, shows the subject matter on the printing plate 3. The printing plate 3 has a plurality of zones 11, 12, 13, between which blank spaces 3' are left. If the printing system is to print in accordance with the forme 3 of FIG. 2, a cellular surface layer, cover or sleeve 6 is made which has ink receiving regions 14, 15, 16, between which regions ink repellent regions 6' are located.

The plate 3 is applied to the forme cylinder 2. The cellular cover 6 is applied to the ink supply cylinder 5. The layer or cover or sleeve 6 is so applied on the ink supplying cylinder 5 that ink transferred from the region 14 via the ink application roller or cylinder 4 is transferred to the zone 11 of the forme 3; similarly, ink in cells or receptor depressions in regions 15, 16 is transferred by the ink application roller 4 to the zones or regions 12, 13 of the forme 3.

Figure 5:
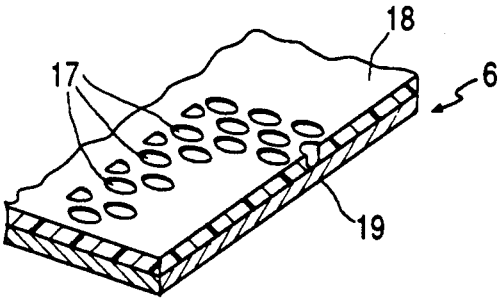
FIG. 5 is a fragmentary view, highly enlarged, of a region of the cellular surface layer.

As best seen in FIG. 5, the ink supplying regions of the cover, jacket or sleeve 6 are formed by depressions 17, formed in a photo-polymer layer 18. The photo-polymer layer 18 is securely attached to a substrate 19.

In accordance with a feature of the invention, thus, the layer 6 receives, supplies and transfers ink only in those regions or zones in which the forme 3 actually requires ink.

Figure 4:
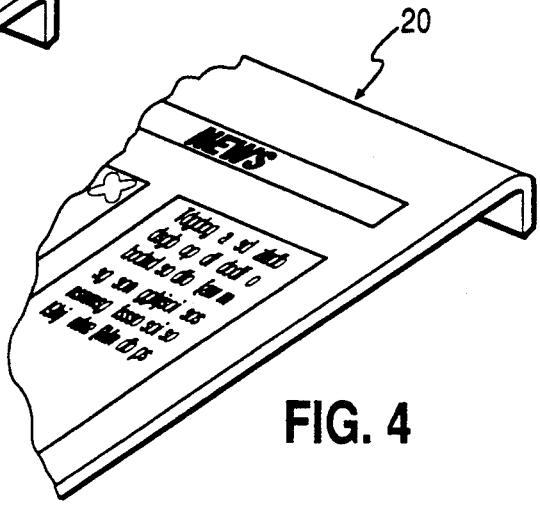
FIG. 4 is another embodiment of a cellular surface layer.
Figure 3:
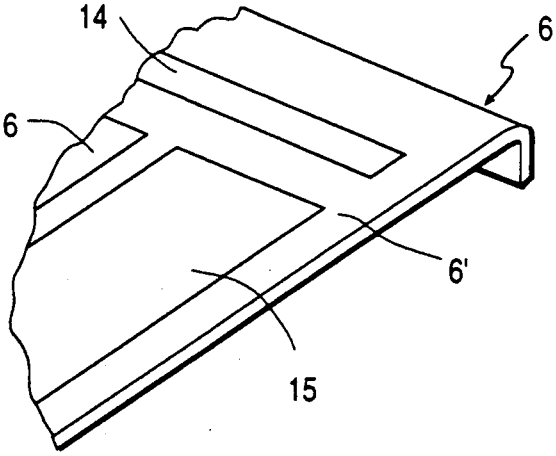
FIG. 3 illustrates, in fragmentary perspective form, the general arrangement of a cellular surface layer to be applied to a cellular surface cylinder.

The layer 6, as shown in FIG. 3, may have uniform distribution of ink receptor depressions or cells. As best seen in FIG. 4, a more precise matching of ink to the subject matter to be printed by the forme 3 can be obtained. The cover jacket or sleeve 20 in accordance with FIG. 4 has the subject matter of the plate 3 applied thereto in all its specific characteristics. The cells are then formed in the jacket 20 so that each one of the ink supplying cells or receptor depressions of the cover or sleeve 20 will transmit and supply ink particles via the ink application roller or cylinder 4 to a position on the forme 3 which directly requires these ink particles.

Figure 6:
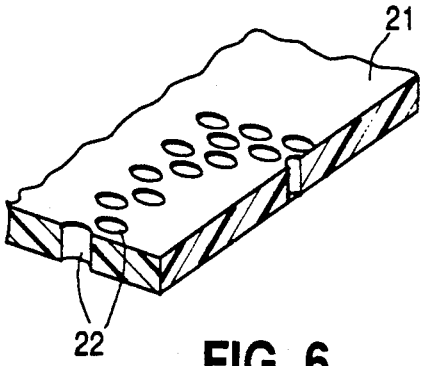
FIG. 6 is a highly enlarged fragmentary part-sectional view of another embodiment of a cellular surface layer plate.

In accordance with a feature of the invention, the cells can extend entirely through the jacket or sleeve applied to the cellular cylinder 5, so that, in effect, the jacket or sleeve may be formed by a screen-printing element. FIG. 6 illustrates a cover, jacket or sleeve 21, in which depressions or cells 22 are provided, passing through the entire thickness of the screen-printing element and the bottom of the cells 22 is formed by the surface of the roller 5 or, if desired, an underlay strip beneath element 21.

Figure 7:
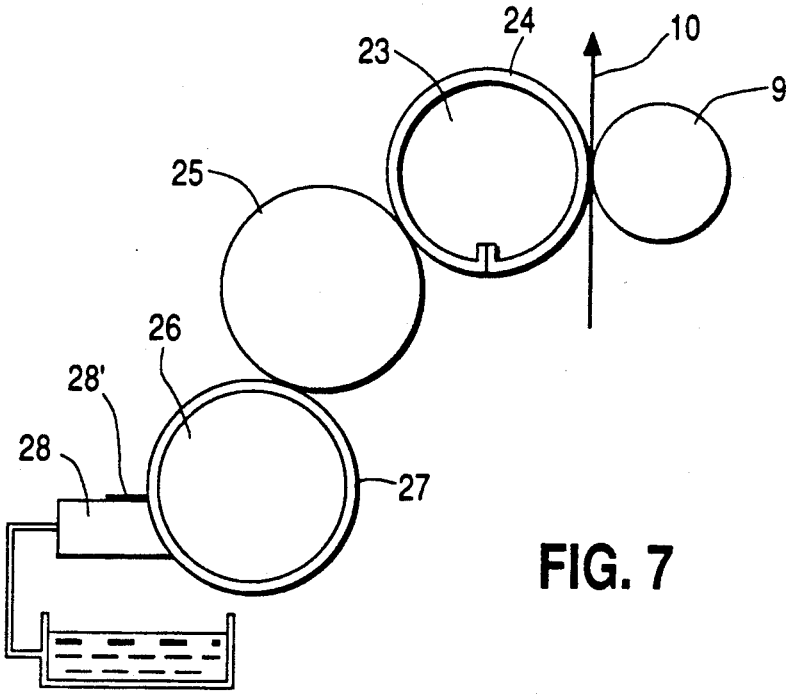
FIG. 7 is a highly schematic side view of a letterpress inker using the present invention.

The system and method of the present invention is not limited to the offset printing method and system. FIG. 7 illustrates a raised letterpress, having a hard plate surface 24 applied to a forme cylinder 23. The raised letter plate 24 receives ink from an ink application roller or cylinder 25, with a yielding, ink transferring and ink accepting surface. The ink application roller or cylinder 25 is in ink transferring engagement with a cellular cylinder 26, which has a cellular surface layer, in form of a sleeve 27. It could be a jacket. In accordance with a feature of the invention, the cover, sleeve or jacket, in short the surface layer 27, carries ink cells or ink receptor depressions only in those regions where printing is actually to be carried out. The layer 27 is shown as a replaceable sleeve. Ink is supplied by a chambered doctor blade unit 28 with a doctor blade 28'. Any other type of inker, however, with a doctor blade may be used to supply ink to the layer 27. In operative state, forme cylinder 23, cylinder 26 and application cylinder or roller 25 all have the same external diameter, and are driven with the same speed.

The layer or sleeve or jacket 27 is so arranged that the distribution of cells will match the printed subject matter on the forme 24. The cells can be so arranged that they are within the regions or zones where printing is to be carried out, or-similar to FIG. 4-only where ink is actually required, so that the ink supply is precisely matched to the ink requirements of the letterpress forme 24. The forme 24 is stretched on the cylinder 23, and the cellular surface layer 27 is stretched on the cylinder 26, or slipped thereover.

The method is suitable also for use in flexo-printing methods and in flexo-printing systems. The printing forme and the cellular jacket are, there, directly applied on the forme cylinder and, respectively, on the cellular carrier roller which is in direct contact with the forme cylinder carrying the printing forme.

The present invention has the specific advantage that no additional positioning or control arrangements are necessary, while still providing for selectively precise matching of ink supplied from the cellular roller or cylinder to the ink requirement of the printing forme on the forme cylinder. This matching can be carried out in circumferential as well as in axial direction. The cells of the cellular jacket or layer can be made with different depths and/or different shape, so that matching of the ink being actually transferred to the printing forme, to the respectively required ink at the various zones is readily possible.

Various changes and modifications may be made, and any features described herein may be used with any of the others, within the scope of the inventive concept.

The photo-polymer layer 18 (FIG. 5), with or without a substrate layer 19, can be of the type usually applied to commercial printing plates with photo-polymer surfaces, for example as sold by BASF Aktienge-sellschaft, Brunckstra ße, D-6700 Ludwigshafen, Federal Republic of Germany.

The screen 21, in which cells 22 can be formed, is any commercially available screen-printing element, for example as manufactured and supplied by Stork Graphics, Raamstraat 1-3, NL-5830 AB Boxmeer, Netherlands.

I claim:

1. A printing machine system comprising a forme cylinder (2,23) having a printing forme (3,24) thereon; said printing forme requiring different amounts of ink in different regions;

an ink supplying cylinder (5,26) having a nonuniform cellular surface (6,27);

means (7,28) for supplying ink to the cells of the nonuniform cellular surface including a doctor blade (7',28') in operative engagement with the cellular surface, and an ink application cylinder (4) with a yielding surface located between said ink supplying cylinder (5,26) and the printing forme (3,24) of the forme cylinder (2,23), and in ink transfer engagement with said cellular surface (6,27) and said printing forme, and wherein the nonuniform cellular surface of the ink supplying cylinder (5,26) has at least one of:

nonuniform cell distribution, nonuniform cell configuration which, at least approximately, is so arranged that ink collecting in the cells of the cellular surface will at least approximately match, the ink requirements of the region of the subject matter to be printed by the printing forme (3,24) to which the ink in the ink cells is delivered.

2. The system of claim 1, wherein said forme cylinder (2, 23) and said ink supplying cylinder (5, 26) having the cellular surface, in operation, have the same diameter and are driven at the same speed.

3. A method to set up a printing machine in a printing system, in which the printing system comprises a forme cylinder (2,23) having a printing forme (3,24) thereon;

an ink supplying cylinder (5,26) having a nonuniform cellular surface (6,27);

means (7,28) for supplying ink to the cells of the cellular surface including a doctor blade (7',28') in operative engagement with the cellular surface, and said method comprising the steps of providing a printing forme which requires different amounts of printing ink in different regions or zones;

determining, based on subject matter to be printed, the requirement of printing ink of the printing forme (2,23) at least in selected zones or regions;

preparing said nonuniform cellular surface (6,27) such that the ink collecting in the cells at least approximately matches the ink requirement of the respective zones of the forme (3,24), by arranging in a nonuniform manner at least one of:

the cell configuration, the cell distribution of the cellular surface (6,27) in zones thereof in such a manner that the ink collecting in the cells will at least approximately match the ink requirement of the respective zones of the forme; and applying said so-prepared cellular surface (6,27) to the ink supplying cylinder (5,26).

4. The method of claim 3, wherein said forme cylinder (2, 23) and said ink supplying cylinder (5, 26) having the cellular surface, in operation, have the same diameter and are driven at the same speed.

5. The method of claim 3, wherein the cellular surface (6, 27) comprises a hard material.

6. The method of claim 3, wherein said ink supplying cylinder (5, 26) with the cellular surface (6, 27) comprises a cylinder core structure (5, 26) and a jacket or cover (6, 27) formed with the cellular surface.

7. The method of claim 6, wherein said jacket or cover comprises a hard metal.

8. The method of claim 6, wherein said jacket or cover comprises a plate element fitted on said core structure.

9. The method of claim 6, wherein said jacket or cover comprises a sleeve.

10. The method of claim 6, wherein said jacket or cover comprises a gravure wrap-around plate element.

11. The method of claim 6, wherein said jacket or cover comprises a gravure printing sleeve.

12. The method of claim 6, wherein said jacket or cover comprises a screen-printing plate element.

13. The method of claim 6, wherein said jacket or cover comprises a screen-printing sleeve.

* * * * *